United States Patent [19]

Daniels

[11] Patent Number: 4,910,437

[45] Date of Patent: Mar. 20, 1990

[54] HIGH-PRESSURE DISCHARGE LAMP

[75] Inventor: Johny A. J. Daniels, Eindhoven, Netherlands

[73] Assignee: U.S. Philips Corporation, New York, N.Y.

[21] Appl. No.: 793,528

[22] Filed: Oct. 31, 1985

[30] Foreign Application Priority Data

Nov. 6, 1984 [NL] Netherlands ..... 8403364

[51] Int. Cl.[4] ..... H05B 41/14

[52] U.S. Cl. ..... 315/208; 315/60

[58] Field of Search ..... 315/208, 60, 200 R, 315/73

[56] References Cited

U.S. PATENT DOCUMENTS

| | | | |
|---|---|---|---|
| 3,894,265 | 7/1975 | Holmes et al. | 315/194 |
| 4,342,948 | 8/1982 | Samuels | 315/290 |
| 4,438,369 | 3/1984 | Hicks et al. | 315/220 |
| 4,464,607 | 8/1984 | Peil et al. | 315/DIG. 7 |

FOREIGN PATENT DOCUMENTS 0168087 1/1986 European Pat. Off. .

*Primary Examiner*—Robert L. Griffin
*Assistant Examiner*—T. Salindong
*Attorney, Agent, or Firm*—Bernard Franzblau

[57] ABSTRACT

A high-pressure discharge lamp comprising a discharge vessel provided with an external auxiliary electrode connected to a starter circuit in the lamp. The starter circuit comprises a voltage division circuit between the connection terminals of the lamp and parallel to the discharge path. A switching element of the starter circuit shunts the voltage division circuit in part and is electrically connected to a control electrode of a semiconductor switch, connected in series with the discharge path and in parallel with the voltage division circuit. As a result a starter circuit and a lamp current limiting circuit are thus combined in the lamp.

21 Claims, 1 Drawing Sheet

HIGH-PRESSURE DISCHARGE LAMP

This invention relates to a high-pressure discharge lamp comprising a discharge vessel provided with two main electrodes between which extends a discharge path and provided with an external auxiliary electrode connected to a starter circuit in the lamp, in which lamp each main electrode is electrically connected to a respective connection terminal of the lamp. The connection terminals are further connected to each other through a voltage division circuit of the starter circuit, wherein the starter circuit also comprises a switching element which partly shunts the voltage division circuit.

A lamp of the kind mentioned in the opening paragraph is known from U.S. Pat. No. 4,447,759. Such a lamp is generally operated with alternating voltage in conjunction with a stabilization ballast. The value of the impedance of the ballast should be chosen in correspondence with the discharge current flowing through the lamp in the operating condition of the lamp. This means that an existing apparatus for operating a high pressure discharge lamp of a given kind cannot be used to operate a lamp of different kind without additional steps being taken e.g., adding an adaptation circuit between the original ballast and the different type of lamp. This is disadvantageous when it is desired to use different high pressure discharge lamps either to obtain a progressively increasing light output or to attain a further saving of energy. The invention has for an object to provide means by which the necessity of taking additional steps is eliminated.

According to the invention, for this purpose a lamp of the kind mentioned in the opening paragraph is characterized in that in series with the discharge path and in parallel with the voltage division circuit there is arranged a semiconductor switch with a control electrode, which control electrode is electrically connected to the switching element.

By the use of a switch connected in series with the discharge path, in the operating condition of the lamp, the current through the lamp is controlled so that it is possible to operate the lamp on equipment provided with a stabilization ballast not specifically adapted to the relevant lamp. When the switch is in the form of a semiconductor switch, the advantage of small dimensions and hence the possibility of incorporation in the lamp is obtained. When the semiconductor switch is arranged in parallel with the voltage division circuit, it is advantageously possible to use for control of the switch the starter circuit present in the lamp.

U.S. Pat. No. 4,342,948 discloses an adaptation circuit for the operation of a high-pressure discharge lamp on equipment provided with a stabilization ballast not adapted to the relevant lamp. In the known adaptation circuit, the switch of the starter circuit is in the form of a controlled semiconductor switch which is connected in series with the discharge path of the lamp connected to the adaptation circuit. The starter circuit is constructed so that ignition pulses in the connected lamp are applied solely to the main electrodes. A transformer winding is included in the series arrangement of switch and discharge path. However, during operation of the lamp the overall lamp current will flow through the transformer winding, which in practice leads to the transformer having comparatively large dimensions so that incorporation in the lamp is hardly possible.

In the known adaptation circuit, further a resistor of comparatively low impedance value is present, which shunts the switch. At the required value of the resistor, this results in that either the lamp current can be controlled to a very small extent by the switch or current flows for a comparatively long time through the resistor, which leads to power dissipation.

In an advantageous embodiment of a lamp according to the invention, the controlled semiconductor switch is shunted by a resistor of at least 1 kΩ. Thus, an ionization current can be maintained through the lamp for the period in which the semiconductor switch is in the non-conductive state.

In a further embodiment of a lamp according to the invention, the voltage division circuit comprises at least two components which are directly connected to each other and between which the switching element is connected, the two components being shunted by a series arrangement of two Zener diodes of opposite polarities. The Zener diodes ensure that variations in the amplitude of the supply voltage have very little influence on the instant of breakdown of the switching element.

In a further improved embodiment, the series arrangement of discharge path and controlled semiconductor switch is shunted by a series arrangement of a resistor and a capacitor. When the lamp is started, such a series arrangement favors the production of a discharge in the discharge vessel. During operation of the lamp, the added series arrangement leads to the discharge in the discharge vessel being reignited more rapidly.

An embodiment of a lamp according to the invention will now be described more fully with reference to the accompanying drawing. In the drawing.

Figure 1:
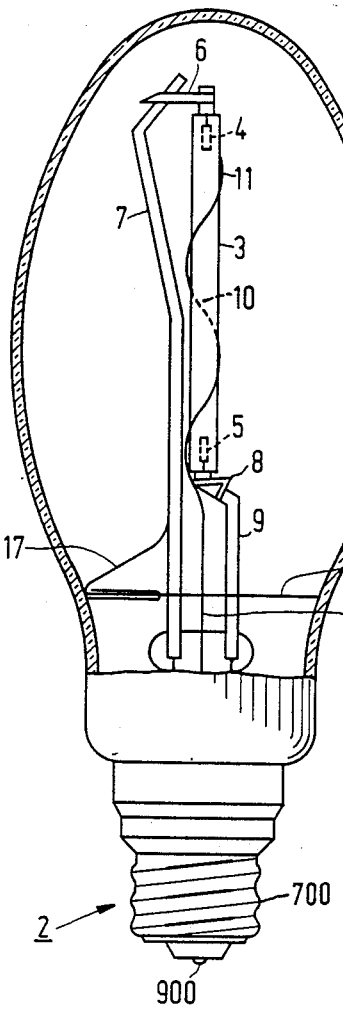
FIG. 1 shows a lamp partly broken away.

In FIG. 1, reference numeral 1 designates an outer bulb of the lamp with a lamp cap 2. The outer bulb encloses a discharge vessel 3 provided with two main electrodes 4,5 between which extends a discharge path 10. The lamp is provided with an external auxiliary electrode 11. The electrode 4 is connected by means of a metal strip 6 to a rigid current conductor 7. The electrode 5 is connected via a metal strip 8 to a rigid current conductor 9. The main electrodes 4,5 are each connected through the rigid current conductors 7,9 to a respective connection terminal of the lamp arranged in the lamp cap 2.

The external auxiliary electrode 11 is connected to a starter circuit in the lamp cap via a current conductor 110. Furthermore, in the outer bulb a heat shield 16 of aluminum is mounted between the discharge vessel 3 and the lamp cap 2. A nickel strip 17 is welded to the rigid current conductor 7 and grips around the heat shield 16, while clampingly surrounding the heat shield 16 and thus positioning it in a simple and adequate manner.

Figure 2:
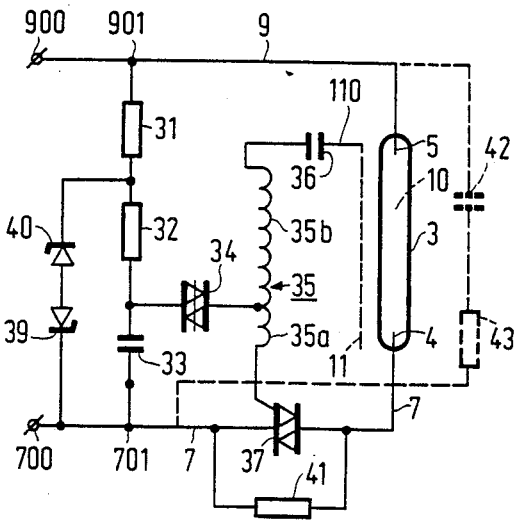
FIG. 2 shows an electric circuit diagram of the lamp.

In FIG. 2 the electric circuit diagram of the lamp is represented. Reference numeral 3 denotes the discharge vessel of the lamp provided with the two main electrodes 4,5 between which extends the discharge path 10. Each of the main electrodes 4,5 is electrically connected through a current conductor 7 and 9, respectively, to a respective connection terminal 700,900 of the lamp.

The external auxiliary electrode 11 is connected through the current conductor 110 to a starter circuit which comprises the elements 31 to 40 and is composed as follows. The connection terminals 700,900 are interconnected through a voltage division circuit of the starter circuit comprising a series arrangement of a resistor 31, a resistor 32 and a capacitor 33. A switching element 34 is connected to a tapping on the voltage division circuit. The switching element is in the form of an uncontrolled voltage-dependent breakdown element with thyristor characteristics. It is, for example, alternatively possible that the switching element be a controlled semiconductor switch whose control is voltage dependent. The switching element 34 is electrically connected through a primary winding 35*a* of the transformer 35 to a control electrode of a controlled semiconductor switch 37. The switch 37 is connected in series with the discharge path and in parallel with the voltage division circuit, as a result of which the capacitor 33 of the voltage division circuit is shunted by the switching element 34. Furthermore, the switch 37 is shunted by a resistor 41. A secondary winding 35*b* of the transformer 35 is connected through a blocking capacitor 36 to the current conductor 110.

A series arrangement, connected with two Zener diodes 39,40 of opposite polarities, forms together with the resistor 31 a connection between the connection terminals 700 and 900.

In a modification of the starter circuit, the position of the switching element 34 and that of the primary winding 35*a* may be interchanged.

In a further modification of the lamp, the series arrangement of the discharge path 10 and the controlled semiconductor switch 37 in the electric circuit diagram is shunted by a series arrangement of a capacitor 42 and a resistor 43. The series arrangement of the capacitor 42 and the resistor 43 may be provided outside the lamp.

The operation of the electric circuit diagram is as follows. When an alternating voltage is applied as a supply voltage to the connection terminals 700,900 via a stabilization ballast, the capacitor 33 is charged via the resistors 31 and 32. When the voltage at the capacitor 33 reaches the breakdown voltage of the switching element 34, the switching element breaks down and becomes conductive. The capacitor 33 is then discharged abruptly via the primary transformer winding 35*a* and the semiconductor switch 37. This abrupt discharge produces a voltage pulse in the transformer 35 which is induced in the secondary transformer winding 35*b*, as a result of which a high instantaneous voltage is applied via the blocking capacitor 36 between the external auxiliary electrode 11 and the main electrodes 4,5 of the discharge vessel 3.

As soon as the current through the switching element 34 falls to zero, the switching element becomes non-conducting again, after which the process described is repeated. The high instantaneous voltage, which due to the process described is applied between the external auxiliary electrode 11 and the main electrodes 4,5, will produce a discharge between the main electrodes via the discharge path 10 and thus cause the lamp to ignite.

The discharge current of the capacitor 33 via the control electrode of the semiconductor switch 37 causes this switch to become conducting. In case the lamp has ignited, a lamp current will flow between the connection terminals 700 and 900 via the main electrodes 4,5 and the discharge path. When the voltage and hence the lamp current fall to zero, the semiconductor switch 37 becomes non-conducting again, whereupon the process described is repeated. During the non-conductive state of the semiconductor switch, a small ionization current can continue to flow through the discharge vessel via the resistor 41. This enhances the reignition of the discharge as soon as the semiconductor switch 37 has been caused to become conducting.

The Zener diodes 39 and 40 ensure that variations in the amplitude of the supply voltage have very little influence on the instant of breakdown of the switching element 34.

In a lamp provided with the series arrangement comprising the capacitor 42 and the resistor 43, the capacitor 42 will be charged during each period of the alternating supply voltage. During starting of the lamp, this results in that the voltage at the connection terminals 700,900 is kept substantially constant immediately after breakdown of the switching element 34, which favors the production of a discharge in the discharge vessel 3. In the operating condition of the lamp, the capacitor 42 will be charged as long as the semiconductor switch 37 is non-conducting. As soon as the semiconductor switch 37 becomes conducting, the capacitor 42 will be discharged via the discharge path. This favors the reignition of the discharge.

In the case of a practical lamp, the latter was operated at an alternating voltage source of 220 V, 50 Hz, and the power consumed by the lamp was 77 W. The lamp was operated in combination with a ballast intended for the operation of a high-pressure mercury vapour discharge lamp of 125 W. The lamp of this example was a high-pressure sodium lamp whose discharge vessel contained 25 mg of an amalgam comprising 18% by weight of Na and 82% by weight of Hg. The discharge vessel further contained xenon at a pressure of about 10 kPa at 300° K. During operation of the lamp, the luminous flux was 6750 lm and the arc voltage between the main electrodes was 120 V. Per half cycle of the alternating voltage, the semiconductor switch 37 was non-conducting for 1.2 ms. The average voltage per half cycle between the connection terminals 700 and 900 was 140 V. The components as shown in the electric circuit diagram of the lamp were dimensioned as follows:

| | |
|---|---|
| resistor 31 | 10 kΩ |
| resistor 32 | 17 kΩ |
| resistor 41 | 10 kΩ |
| resistor 43 | 1 kΩ |
| capacitor 33 | 47 nF |
| capacitor 36 | 2.2 nF |
| capacitor 42 | 30 nF |
| Zener diode 39 | makers Philips, type BZT03 |
| Zener diode 40 | breakdown voltage 180 V |
| Switching element 34 | type SIDAC, makers Shindengen, type K 1 V 24, breakdown voltage 120 V |
| semiconductor switch 37 | TRIAC, makers Philips, type BT 139 |
| transformer 35 | number of primary windings 25<br>number of secondary windings 600<br>ferrite core. |

For comparison it should be stated that during operation of a 125 W high-pressure mercury vapor discharge lamp on the stabilization ballast intended therefor, the luminous flux is about 6300 lm. The lamp according to the invention therefore yields during operation an energy saving of about 40% with a comparable luminous flux.

What is claimed is:

1. A high-pressure discharge lamp comprising a discharge vessel provided with two main electrodes with a discharge path therebetween and provided with an external auxiliary electrode connected to a starter circuit in the lamp, a pair of connection terminals for connection to a source of supply voltage, means further connecting the connection terminals to each other through a voltage division circuit of the starter circuit, said starter circuit also comprising a switching element which partly shunts the voltage division circuit, a controlled semiconductor switch connected in series circuit with the vessel discharge path across said connection terminals and with said series circuit connected in parallel with the voltage division circuit, and means electrically connecting a control electrode of the semiconductor switch to the switching element.

2. A lamp as claimed in claim 1, characterized in that the controlled semiconductor switch is shunted by a resistor of at least 1 kΩ.

3. A lamp as claimed in claim 1, characterized in that the voltage division circuit comprises at least two components which are directly electrically connected to each other and between which the switching element is arranged, and in that the two components are shunted by a series arrangement of two Zener diodes connected with opposite polarities.

4. A lamp as claimed in claim 1, characterized in that the series circuit of lamp discharge path and controlled semiconductor switch is shunted by a series arrangement of a resistor and a capacitor.

5. A lamp as claimed in claim 2, wherein the voltage division circuit comprises at least two series connected electrical components directly connected to each other and with the switching element connected to a junction point thereof, and means connecting two Zener diodes in series opposition and in shunt with said two electrical components.

6. A lamp as claimed in claim 2, characterized in that the series circuit of lamp discharge path and controlled semiconductor switch is shunted by a series arrangement of a resistor and a capacitor.

7. A lamp as claimed in claim 3, characterized in that the series circuit of lamp discharge path and controlled semiconductor switch is shunted by a series arrangement of a resistor and a capacitor.

8. A starting and operating circuit for a high-pressure discharge lamp of the type provided with an external auxiliary start electrode and two main electrodes which define a main discharge path through the lamp, said circuit comprising: a pair of input terminals for connection to a source of AC supply voltage, a controlled semiconductor switch connected in a series circuit with the main discharge path of the lamp to said pair of terminals, a lamp starter circuit comprising a transformer having a secondary winding coupled to the lamp auxiliary start electrode and a primary winding, the starter circuit including a voltage division circuit and a switching element coupled to the voltage division circuit and the transformer primary winding so that the switching element partly shunts the voltage division circuit, means coupling the voltage division circuit to said pair of terminals so that said voltage division circuit and said series circuit are connected in parallel to said pair of terminals, and means connecting a control electrode of the controlled semiconductor switch to said voltage division circuit via the switching element.

9. A circuit as claimed in claim 8 wherein said coupling means allows an alternating current to flow through said voltage division circuit.

10. A circuit as claimed in claim 8 wherein the voltage division circuit includes a capacitor connected in series with at least one resistor and said switching element is voltage-sensitive and is coupled to said capacitor so as to periodically discharge the capacitor via the transformer primary winding and the control electrode of the semiconductor switch thereby to induce a high voltage in the transformer secondary winding.

11. A circuit as claimed in claim 10 wherein the switching element is connected to a junction point between the capacitor and said one resistor and to a terminal of said transformer primary winding.

12. A circuit as claimed in claim 8 wherein the controlled semiconductor switch is bidirectional, said circuit further comprising a resistor connected in parallel with the semiconductor switch and having a resistance value such as to maintain an ionization current in the lamp when the semiconductor switch is cut-off.

13. A circuit as claimed in claim 8 wherein the voltage division circuit includes a capacitor connected in series with at least one resistor and said switching element is connected to a junction point thereof, and means connecting two Zener diodes in series opposition across the series connection of the capacitor and the one resistor.

14. A circuit as claimed in claim 8 further comprising a series arrangement of a capacitor and an impedance element connected in parallel with said series circuit whereby the capacitor will discharge via the lamp main discharge path and the controlled semiconductor switch when the semiconductor switch is made to conduct.

15. A circuit as claimed in claim 8 wherein the voltage division circuit includes a capacitor connected in series with at least one resistor and said switching element is connected to a junction poit thereof and to the control electrode of the semiconductor switch via the transformer primary winding so that the switching element provides a discharge path for the capacitor at a given point in each half cycle of the AC supply voltage and via the transformer primary winding and the control electrode of the semiconductor switch thereby to trigger the semiconductor switch into conduction.

16. A unitary lamp unit comprising a high-pressure discharge lamp having a base housing with a starting and operating circuit as claimed in claim 8 mounted within said base housing to form said unitary lamp unit, said base housing having first and second connection terminals for supplying AC voltage to the pair of terminals of the starting and operating circuit.

17. A lamp as claimed in claim 1 wherein said semiconductor switch and said vessel discharge path are connected in series across the connection terminals via a current path that excludes said auxiliary electrode.

18. A lamp as claimed in claim 1 wherein said further connecting means connect the voltage division circuit to the connection terminals via a current path that allows an alternating current to flow through said voltage division circuit from said connection terminals.

19. A circuit as claimed in claim 8 wherein the switching element is coupled to the voltage division circuit and the primary winding so that the switching element and primary winding together provide a shunt current path that shunts a current flowing in a part of the voltage division circuit.

20. A lamp as claimed in claim 1 further comprising a transformer having a primary winding and a secondary winding coupled to said auxiliary electrode, wherein the voltage division circuit includes a capacitor connected in series with at least one resistor, and the switching element is coupled to said capacitor and to said control electrode via said primary winding so as to periodically discharge the capacitor via the transformer primary winding and the control electrode of the semiconductor switch thereby to induce a high voltage in the transformer secondary winding.

21. A lamp as claimed in claim 1 wherein the semiconductor switch is connected in series with the vessel discharge path so that a discharge current flowing in the discharge vessel from the connection terminals also flows through the semiconductor switch.

* * * * *